US012534277B2

(12) United States Patent
Yan

(10) Patent No.: US 12,534,277 B2
(45) Date of Patent: Jan. 27, 2026

(54) BREATHING LID CAPABLE OF ADAPTIVELY BALANCING AIR PRESSURE

(71) Applicant: SHANGHAI FENGQI INDUSTRIAL CO., LTD., Shanghai (CN)

(72) Inventor: Jun Yan, Shanghai (CN)

(73) Assignee: SHANGHAI FENGQI INDUSTRIAL CO., LTD., Shanghai (CN)

( * ) Notice: Subject to any disclaimer, the term of this patent is extended or adjusted under 35 U.S.C. 154(b) by 0 days.

(21) Appl. No.: 18/795,321

(22) Filed: Aug. 6, 2024

(65) Prior Publication Data

US 2024/0391663 A1 Nov. 28, 2024

Related U.S. Application Data

(63) Continuation of application No. PCT/CN2022/130088, filed on Nov. 4, 2022.

(30) Foreign Application Priority Data

Sep. 7, 2022 (CN) ..... 202222371938.7

(51) Int. Cl.
*B65D 51/16* (2006.01)

(52) U.S. Cl.
CPC ..... *B65D 51/16* (2013.01)

(58) Field of Classification Search
CPC .. B21D 51/44; B21D 51/365; B65D 51/2828; B65D 51/1661; B65D 51/1655; B65D 51/1644; B65D 51/1633; B65D 51/1616; B65D 51/1611; B65D 51/1605; B65D 51/16; B65D 53/02
See application file for complete search history.

(56) References Cited

U.S. PATENT DOCUMENTS

| | | | | |
|---|---|---|---|---|
| 4,828,139 | A * | 5/1989 | Capitani | B65D 45/345 220/319 |
| 10,752,422 | B2 * | 8/2020 | Gubler | B65D 53/02 |
| 2009/0255927 | A1 * | 10/2009 | Flecknoe-Brown | C12H 1/22 426/11 |
| 2015/0060446 | A1 * | 3/2015 | Park | B65D 81/2038 220/345.6 |
| 2016/0083155 | A1 * | 3/2016 | Anderson | B65D 51/1616 220/367.1 |
| 2016/0376071 | A1 * | 12/2016 | Stodd | B65D 51/1677 220/359.1 |
| 2018/0265263 | A1 * | 9/2018 | Li | B65D 43/0202 |
| 2019/0161248 | A1 * | 5/2019 | Ramsey | B65D 53/02 |
| 2021/0253317 | A1 * | 8/2021 | Brubaker | F26B 21/08 |

* cited by examiner

*Primary Examiner* — Kareen K Thomas
(74) *Attorney, Agent, or Firm* — HOWARD M COHN and Associates, LLC

(57) ABSTRACT

The disclosure discloses a breathing lid capable of adaptively balancing air pressure, specifically relating to the technical field of airbags capable of adapting to air pressure. The breathing lid capable of adaptively balancing air pressure includes a can lid and an airbag body. The airbag body is clamped in the can lid. The airbag body includes a connecting outer ring, a soft connecting inner ring, a ventilation component and a mounting seat. The connecting outer ring is in an annular structure, and the soft connecting inner ring is in a convex structure. The soft connecting inner ring is arranged on an inner side of the connecting outer ring, and the mounting seat is mounted on the inner side of the connecting outer ring. The mounting seat is provided with the ventilation component.

5 Claims, 3 Drawing Sheets

BREATHING LID CAPABLE OF ADAPTIVELY BALANCING AIR PRESSURE

TECHNICAL FIELD

The disclosure relates to the technical field of airbags capable of adapting to air pressure, and more specifically relates to a breathing lid capable of adaptively balancing air pressure.

BACKGROUND

At present, a product inside a can is usually sealed with an aluminum film or tin foil. However, during actual use, especially in areas with great pressure difference and temperature difference such as aircraft transportation, or for microbial products that generate gas, such as protein powder, coffee beans, milk powder, etc., it is prone to deformation of the can or rupture of the sealing film. If the external pressure is too high, the side wall of the can will be squeezed, which will lead to concave deformation of the can. If the external pressure is too low, the inner wall of the can will swell, and the can may even burst directly, which will affect the sales of the product. The method of providing a through hole in the sealing film and arranging a thin film with a waterproof and dustproof screen in the through hole may solve the problem of air pressure, but there is gas exchange between the inside and the outside of the can, which easily leads to the deterioration of the product in the can. Therefore, there is an urgent need for an improved technology to solve this problem in the prior art.

SUMMARY

In order to overcome the above defect in the prior art, an embodiment of the disclosure provides a breathing lid capable of adaptively balancing air pressure so as to solve the problem proposed in the Background.

In order to achieve the above objective, the disclosure provides the following technical solution: a breathing lid capable of adaptively balancing air pressure includes a can lid and an airbag body. The airbag body is clamped in the can lid. The airbag body includes a connecting outer ring, a soft connecting inner ring, a ventilation component, and a mounting seat. The connecting outer ring is in an annular structure, and the soft connecting inner ring is in a convex structure. The soft connecting inner ring is arranged on an inner side of the connecting outer ring, and the mounting seat is mounted on the inner side of the connecting outer ring. The mounting seat is provided with the ventilation component. The ventilation component includes a connecting column, a ventilation column, a silicone sleeve, an air-permeable film, and a limiting convex ring. The connecting column is arranged on the mounting seat, and the ventilation column is arranged in the connecting column. The silicone sleeve is sleeved at a top end of the ventilation column, and the limiting convex ring is arranged at a side end of the ventilation column. The air-permeable film is arranged at a bottom end of the ventilation column.

In a preferred implementation, the connecting outer ring, the soft connecting inner ring, the connecting column, the ventilation column, the limiting convex ring, and the mounting seat form an integrated structure.

In a preferred implementation, a through hole is provided in the ventilation column.

In a preferred implementation, a recess matched with the air-permeable film is provided at a bottom end of the connecting column.

In a preferred implementation, a plurality of exhaust grooves is provided at a side end of the connecting outer ring.

Compared with the prior art, the disclosure has the following technical effects and advantages:

According to the disclosure, a mold is used to make the airbag body. The airbag body includes the connecting outer ring, the soft connecting inner ring, the ventilation component and the mounting seat. Before use, the silicone sleeve is sleeved at the top end of the ventilation column. The limiting convex ring is arranged at the outer side end of the ventilation column so as to prevent the silicone sleeve from being pushed off the ventilation column when there is an excessive air pressure inside the can. The connecting outer ring of the airbag body is clamped in the can lid, and the can lid is mounted on the can. In this way, when the air pressure inside the can is greater than the air pressure outside the can, air in the can enters a gap between the silicone sleeve and the ventilation column through the through hole in the ventilation column and then flows out of the gap between the silicone sleeve and the ventilation column, which prevents the can from bursting due to the excessive pressure inside the can. When the air pressure inside the can is less than the air pressure outside the can, the soft connecting inner ring is recessed downward so as to prevent concave deformation of the can due to the too low pressure in the can. The disclosure can be convenient for adaptively balancing air pressures inside and outside the can, and prevent external gas from entering the can, thereby avoiding deterioration of products in the can.

Reference signs: 1, can lid; 2, airbag body; 21, connecting outer ring; 22, soft connecting inner ring; 3, ventilation component; 31, connecting column; 32, ventilation column; 33, silicone sleeve; 34, air-permeable film; 35, limiting convex ring; 4, mounting seat; and 5, exhaust groove.

DETAILED DESCRIPTION

The technical solutions in the embodiments of the disclosure will be clearly and completely described below with reference to the accompanying drawings in the embodiments of the disclosure. It is apparent that the described embodiments are only a part, rather than all of the embodiments of the disclosure. All other embodiments obtained by those of ordinary skill in the art based on the embodiments of the disclosure without creative work are within the protection scope of the disclosure.

Figure 1:
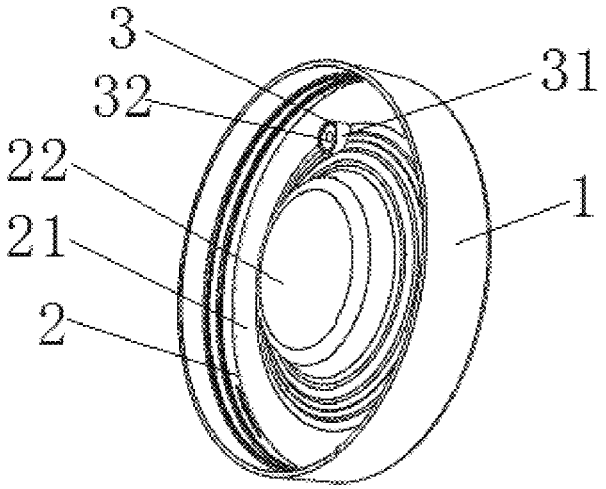
FIG. 1 is a three-dimensional view of the disclosure.
Figure 2:
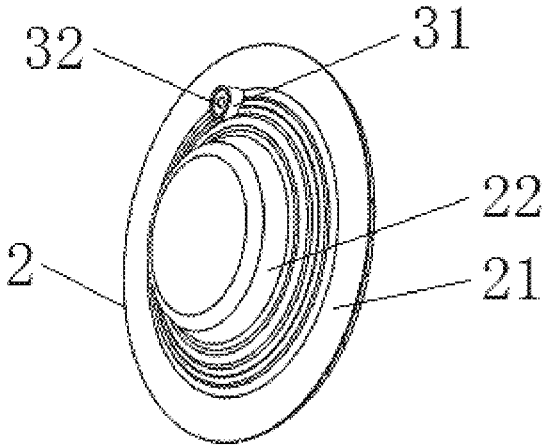
FIG. 2 is a three-dimensional view of an airbag body of the disclosure.
Figure 3:
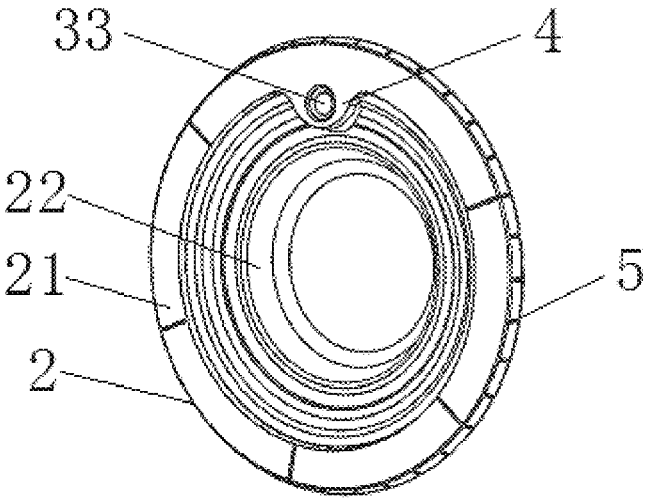
FIG. 3 is a three-dimensional view of FIG. 2 from another viewing angle.
Figure 4:
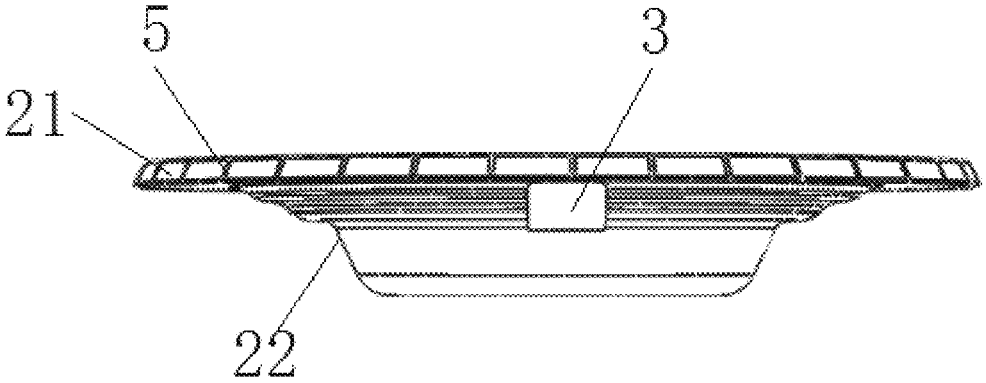
FIG. 4 is a top view of the airbag body of the disclosure.
Figure 5:
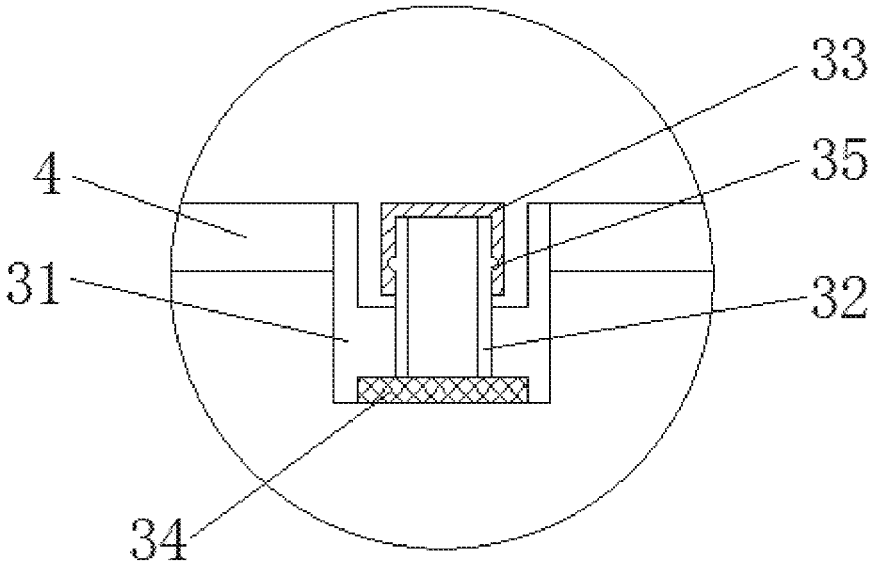
FIG. 5 is a sectional view of a ventilation component of the disclosure.

A breathing lid capable of adaptively balancing air pressure, as shown in FIG. 1 to FIG. 5, includes a can lid 1 and an airbag body 2. The airbag body 2 is clamped in the can lid 1. The airbag body 2 includes a connecting outer ring 21, a soft connecting inner ring 22, a ventilation component 3, and a mounting seat 4. The connecting outer ring 21 is in an annular structure, and the soft connecting inner ring 22 is in a convex structure. The soft connecting inner ring 22 is arranged on an inner side of the connecting outer ring 21, and the mounting seat 4 is mounted on the inner side of the connecting outer ring 21. The mounting seat 4 is provided with the ventilation component 3. The ventilation component 3 includes a connecting column 31, a ventilation column 32, a silicone sleeve 33, an air-permeable film 34, and a limiting convex ring 35. The connecting column 31 is arranged on the mounting seat 4, and the ventilation column 32 is arranged in the connecting column 31. The silicone sleeve 33 is sleeved at a top end of the ventilation column 32, and the limiting convex ring 35 is arranged at a side end of the ventilation column 32. The air-permeable film 34 is arranged at a bottom end of the ventilation column 32.

In a preferred implementation, the connecting outer ring 21, the soft connecting inner ring 22, the connecting column 31, the ventilation column 32, the limiting convex ring 35, and the mounting seat 4 form an integrated structure, which is convenient for direct press molding and thus convenient for production and manufacturing.

In a preferred implementation, a through hole is provided in the ventilation column 32. In this way, when the air pressure inside the can is greater than the air pressure outside the can, gas in the can can flow to the outside through the through hole in the ventilation column 32.

In a preferred implementation, a recess matched with the air-permeable film 34 is provided at a bottom end of the connecting column 31 so as to prevent the product in the can from entering the through hole in the ventilation column 32.

In a preferred implementation, a plurality of exhaust grooves 5 is provided at a side end of the connecting outer ring 21 so as to prevent the connecting outer ring 21 and the can lid 1 from forming a sealed space.

Based on the above, according to the breathing lid capable of adaptively balancing air pressure provided in the disclosure, a mold is used to make the airbag body 2. The airbag body 2 includes the connecting outer ring 21, the soft connecting inner ring 22, the ventilation component 3 and the mounting seat 4. Before use, the silicone sleeve 33 is sleeved at the top end of the ventilation column 32. The limiting convex ring 35 is arranged at the outer side end of the ventilation column 32 so as to prevent the silicone sleeve 33 from being pushed off the ventilation column 32 when there is an excessive air pressure inside the can. The connecting outer ring 21 of the airbag body 2 is clamped in the can lid 1, and the can lid 1 is mounted on the can. In this way, when the air pressure inside the can is greater than the air pressure outside the can, air in the can enters a gap between the silicone sleeve 33 and the ventilation column 32 through the through hole in the ventilation column 32 and then flows out of the gap between the silicone sleeve 33 and the ventilation column 32, which prevents the can from bursting due to the excessive pressure in the can. When the air pressure inside the can is less than the air pressure outside the can, the soft connecting inner ring 22 is recessed downward so as to prevent concave deformation of the can due to the too low pressure in the can. The disclosure can be convenient for adaptively balancing air pressures inside and outside the can, and prevent outside gas from entering the can, thereby avoiding deterioration of products in the can.

It should be finally noted that: firstly, in the description of this application, it should be noted that unless otherwise specified and limited, the terms "mounted", "connected with" and "connected to" should be broadly understood, which may be mechanical connection or electrical connection, or internal communication between two elements, or direct connection; and the terms "up", "down", "left" and "right" are merely used for indicating a relative position relationship. When the absolute position of the described object changes, the relative position relationship may also change.

Secondly, in the accompanying drawings of the embodiments disclosed in the disclosure, only the structures related to the disclosed embodiments are involved, and for other structures, reference may be made to the usual design; and in the case of no conflict, the same embodiments and different embodiments of the disclosure may be combined with each other.

Finally, the above description is merely preferred embodiments of the disclosure and is not intended to limit the disclosure. Any modifications, equivalent substitutions and improvements made within the spirit and principles of the disclosure shall fall within the protection scope of the disclosure.

What is claimed is:

1. A breathing lid capable of adaptively balancing air pressure, comprising a can lid (1) and an airbag body (2), wherein the airbag body (2) is clamped in the can lid (1); the airbag body (2) comprises a connecting outer ring (21), a soft connecting inner ring (22), a ventilation component (3), and a mounting seat (4); the connecting outer ring (21) is in an annular structure, and the soft connecting inner ring (22) is in a convex structure; the soft connecting inner ring (22) is arranged on an inner side of the connecting outer ring (21), and the mounting seat (4) is mounted on the inner side of the connecting outer ring (21); the mounting seat (4) is provided with the ventilation component (3); the ventilation component (3) comprises a connecting column (31), a ventilation column (32), a silicone sleeve (33), an air-permeable film (34), and a limiting convex ring (35); the connecting column (31) is arranged on the mounting seat (4), and the ventilation column (32) is arranged in the connecting column (31); the silicone sleeve (33) is at a top end of the ventilation column (32), and the limiting convex ring (35) is arranged at a side end of the ventilation column (32); and the air-permeable film (34) is arranged at a bottom end of the ventilation column (32).

2. The breathing lid capable of adaptively balancing air pressure according to claim 1, wherein the connecting outer ring (21), the soft connecting inner ring (22), the connecting column (31), the ventilation column (32), the limiting convex ring (35), and the mounting seat (4) form an integrated structure.

3. The breathing lid capable of adaptively balancing air pressure according to claim 1, wherein a through hole is provided in the ventilation column (32).

4. The breathing lid capable of adaptively balancing air pressure according to claim 1, wherein a recess matched with the air-permeable film (34) is provided at a bottom end of the connecting column (31).

5. The breathing lid capable of adaptively balancing air pressure according to claim 1, wherein a plurality of exhaust grooves (5) is provided at a side end of the connecting outer ring (21).

* * * * *